US010600551B2

(12) United States Patent
Yoshida et al.

(10) Patent No.: US 10,600,551 B2
(45) Date of Patent: Mar. 24, 2020

(54) REACTION HAVING OUTER PERIPHERAL IRON CORE

(71) Applicant: FANUC CORPORATION, Yamanashi (JP)

(72) Inventors: Tomokazu Yoshida, Yamanashi (JP); Masatomo Shirouzu, Yamanashi (JP); Kenichi Tsukada, Yamanashi (JP)

(73) Assignee: FANUC CORPORATION, Yamanashi (JP)

( * ) Notice: Subject to any disclaimer, the term of this patent is extended or adjusted under 35 U.S.C. 154(b) by 63 days.

(21) Appl. No.: 15/989,358

(22) Filed: May 25, 2018

(65) Prior Publication Data

US 2018/0350504 A1 Dec. 6, 2018

(30) Foreign Application Priority Data

Jun. 5, 2017 (JP) ..... 2017-110808

(51) Int. Cl.

| | |
|---|---|
| ***H01F 27/24*** | (2006.01) |
| ***H01F 27/26*** | (2006.01) |
| ***H01F 27/28*** | (2006.01) |
| ***H01F 27/30*** | (2006.01) |
| ***H01F 37/00*** | (2006.01) |
| ***H01F 3/14*** | (2006.01) |

(52) U.S. Cl.

CPC ..... *H01F 27/26* (2013.01); *H01F 3/14* (2013.01); *H01F 27/263* (2013.01); *H01F 27/28* (2013.01); *H01F 27/306* (2013.01); *H01F 37/00* (2013.01)

(58) Field of Classification Search

CPC ..... H01F 27/26; H01F 3/14; H01F 27/263

See application file for complete search history.

(56) References Cited

U.S. PATENT DOCUMENTS

| | | | | |
|---|---|---|---|---|
| 8,963,677 | B2 * | 2/2015 | Xu | H01F 27/06 336/210 |
| 10,008,322 | B2 * | 6/2018 | Bhide | H01F 37/00 |
| 2009/0261939 | A1 * | 10/2009 | Shudarek | H01F 3/10 336/212 |
| 2013/0187741 | A1 * | 7/2013 | Goodrich | H01F 3/10 336/170 |
| 2016/0055959 | A1 * | 2/2016 | Xu | H01F 27/24 336/170 |
| 2016/0125998 | A1 * | 5/2016 | Bhide | H01F 37/00 336/5 |

(Continued)

FOREIGN PATENT DOCUMENTS

| | | | |
|---|---|---|---|
| DE | 1513862 | A1 | 4/1969 |
| JP | 2000-077242 | A | 3/2000 |

(Continued)

*Primary Examiner* — Ronald Hinson

(74) *Attorney, Agent, or Firm* — RatnerPrestia

(57) ABSTRACT

A core body of a reactor includes an outer peripheral iron core composed of a plurality of outer peripheral iron core portions, at least three iron cores coupled to inner surfaces of the plurality of outer peripheral iron core portions, and coils. Gaps, which can be magnetically coupled, are formed between one iron core and another iron core adjacent thereto. The reactor further includes a fixture which extends through the interior of the core body in a region between the outer peripheral iron core and the gaps to fasten opposite ends of the at least three iron cores to each other.

7 Claims, 6 Drawing Sheets

(56) References Cited

U.S. PATENT DOCUMENTS

| | | | | |
|---|---|---|---|---|
| 2016/0343503 | A1* | 11/2016 | Ueno et al. | H01F 30/08 |
| 2017/0011842 | A1 | 1/2017 | Ishigaki et al. | |
| 2017/0040099 | A1* | 2/2017 | Bhide | H01F 27/245 |

FOREIGN PATENT DOCUMENTS

| | | | |
|---|---|---|---|
| JP | 2008177500 | A | 7/2008 |
| JP | 2008-210998 | A | 9/2008 |
| JP | 2015142095 | A | 8/2015 |
| JP | 2015159657 | A | 9/2015 |
| JP | 2017059805 | A | 3/2017 |
| WO | 2015142354 | A1 | 9/2015 |

* cited by examiner

REACTION HAVING OUTER PERIPHERAL IRON CORE

CROSS-REFERENCE TO RELATED APPLICATION

This application is a new U.S. Patent Application that claims benefit of Japanese Patent Application No. 2017-110808, filed Jun. 5, 2017, the disclosure of this application is being incorporated herein by reference in its entirety for all purposes.

BACKGROUND OF THE INVENTION

1. Field of the Invention

The present invention relates to a reactor having an outer peripheral iron core.

2. Description of Related Art

A Reactor includes a plurality of iron core coils, and each iron core coil includes an iron core and a coil wound around the iron core. Predetermined gaps are formed between the plurality of iron cores. Refer to, for example, Japanese Unexamined Patent Publication (Kokai) No. 2000-77242 and Japanese Unexamined Patent Publication (Kokai) No. 2008-210998.

SUMMARY OF THE INVENTION

There are reactors in which a plurality of iron core coils are arranged inside an outer peripheral iron core composed of a plurality of outer peripheral iron core portions. In such reactors, each iron core is integrally formed with the respective peripheral iron core portion. Predetermined gaps are formed between adjacent iron cores in the center of the reactor. In such a case, in order to firmly retain the outer peripheral iron core, a through-hole is formed in the center of the reactor, a rod extends through the through-hole, and both ends of the rod are fastened to the end faces of the reactor by means of flexible metal plates or the like.

However, since the gaps are located at the center of the reactor, forming a through-hole shortens the gap length accordingly. Since there is a portion where the magnetic flux does not pass through the through-hole, if the gap length becomes short, an expected inductance cannot be guaranteed. Thus, in order to guarantee the necessary gap length, it is necessary to increase the width of the iron core and extend the gaps radially outward, resulting in a problem that the iron cores and the outer peripheral iron core become large.

Thus, a reactor which is capable of tightly fastening a plurality of iron cores without an increase in size is desired.

According to the first aspect of the present disclosure, there is provided a reactor comprising a core body, the core body comprising an outer peripheral iron core composed of a plurality of outer peripheral iron core portions, at least three iron cores coupled to inner surfaces of the plurality of outer peripheral iron core portions, and coils wound around the at least three iron cores, wherein gaps, which can be magnetically coupled, are formed between one of the at least three iron cores and another iron core adjacent thereto, the reactor further comprising a fixture which extends through the interior of the core body in a region between the outer peripheral iron core and the gaps to fasten opposite ends of the at least three iron cores to each other.

In the first aspect, since the fixture extends through the interior of the core body in the region between the outer peripheral iron core and the gaps, it is not necessary to increase the width of the iron cores to ensure the gap length. Thus, it is possible to tightly fasten the plurality of iron cores without an increase in size.

The object, features, and advantages of the present disclosure, as well as other objects, features and advantages, will be further clarified by the detailed description of the representative embodiments of the present disclosure shown in the accompanying drawings.

DETAILED DESCRIPTION

Figure 1:
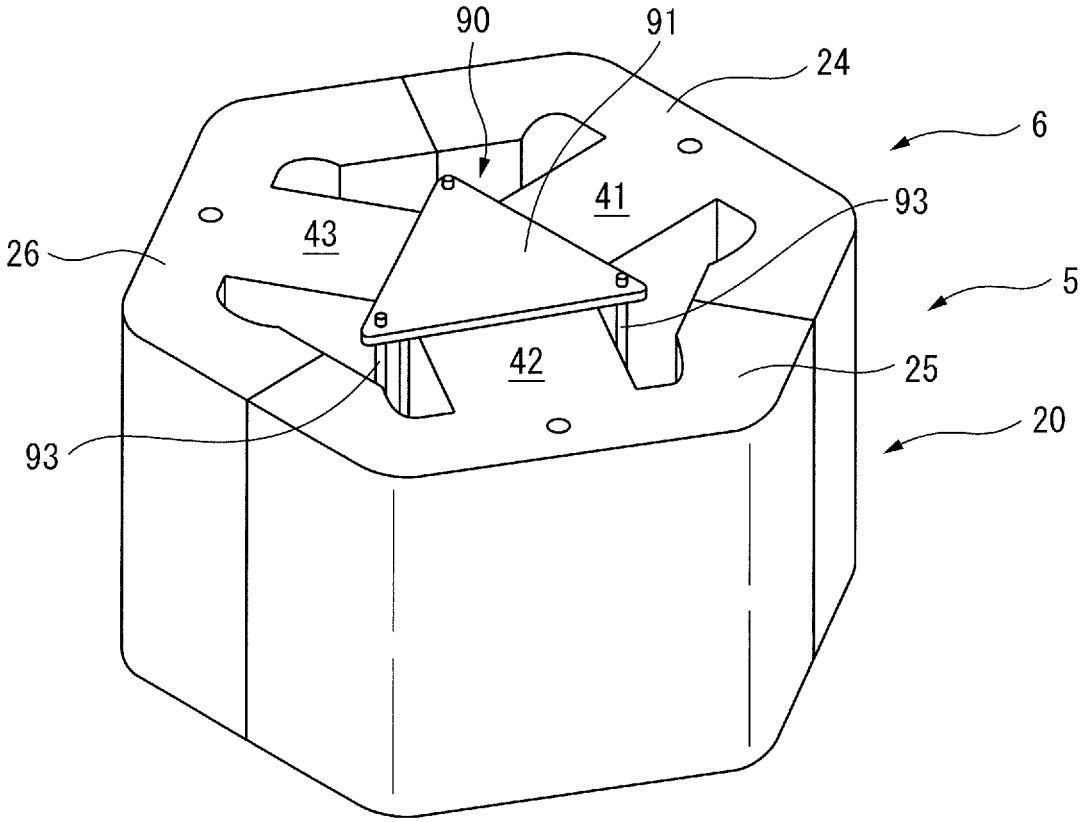
FIG. 1 is a perspective view of a reactor according to a first embodiment.

The embodiments of the present invention will be described below with reference to the accompanying drawings. In the following drawings, the same components are given the same reference numerals. For ease of understanding, the scales of the drawings have been appropriately modified.

In the following description, a three-phase reactor will be described as an example. However, the present disclosure is not limited in application to a three-phase reactor, but can be broadly applied to any multiphase reactor requiring constant inductance in each phase. Further, the reactor according to the present disclosure is not limited to those provided on the primary side or secondary side of the inverters of industrial robots or machine tools, but can be applied to various machines.

Figure 2:
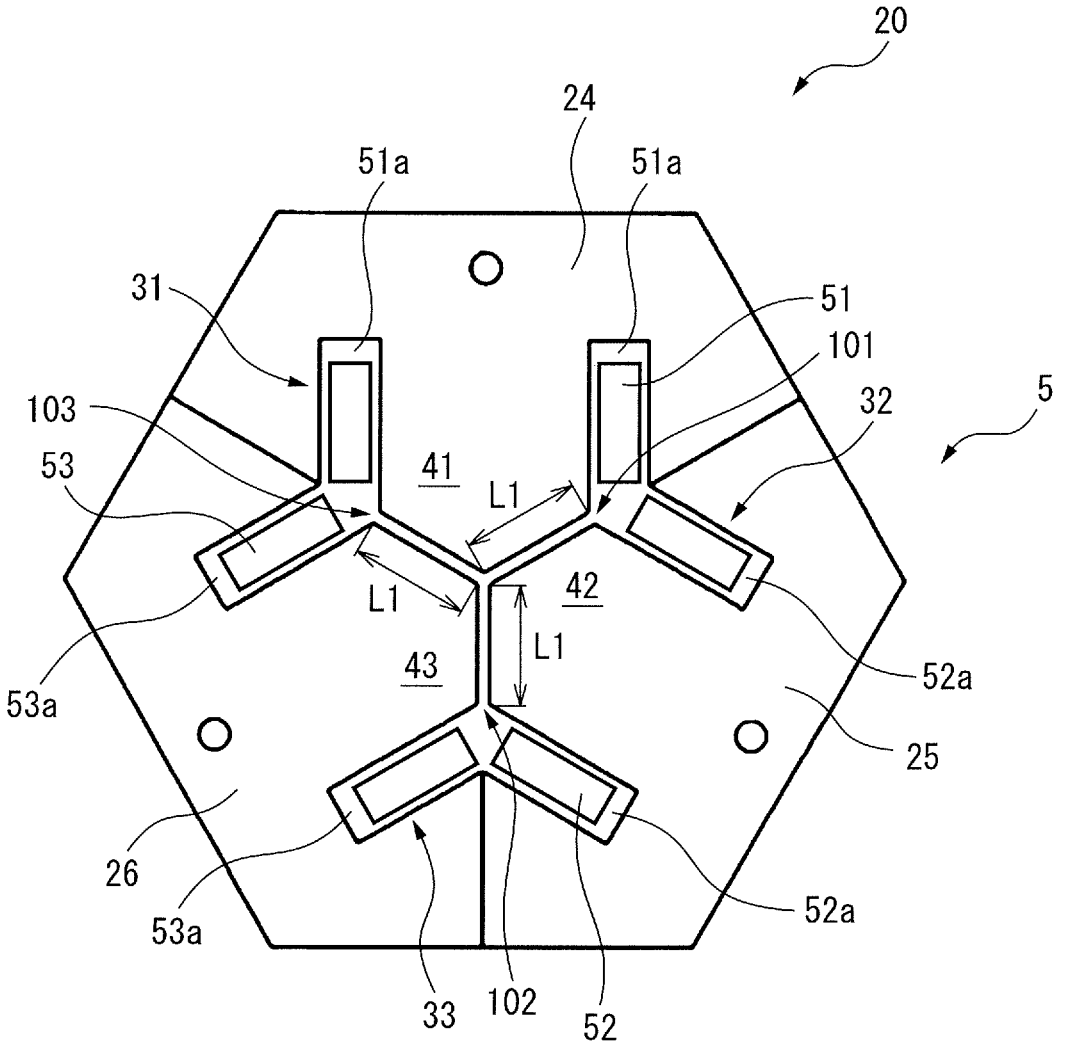
FIG. 2 is a cross-sectional view of the core body of the reactor according to the first embodiment.

FIG. 1 is a perspective view of a reactor according to a first embodiment. FIG. 2 is a cross-sectional view of the core body of a reactor according to the first embodiment. As shown in FIG. 1 and FIG. 2, a core body 5 of a reactor 6 includes an annular outer peripheral iron core 20 and three iron core coils 31 to 33 arranged inside the outer peripheral iron core 20. In FIG. 1, the iron core coils 31 to 33 are disposed inside the substantially hexagonal outer peripheral iron core 20. These iron core coils 31 to 33 are arranged at equal intervals in the circumferential direction of the core body 5.

Note that the outer peripheral iron core 20 may have another rotationally symmetrical shape, such as a circular shape. In such a case, the end plate 81, which is described later, has a shape corresponding to that of the outer peripheral iron core 20. Furthermore, the number of iron core coils may be a multiple of three, whereby the reactor 6 can be used as a three-phase reactor.

As can be understood from the drawings, the iron core coils 31 to 33 include iron cores 41 to 43, which extend in the radial directions of the outer peripheral iron core 20, and coils 51 to 53 wound around the iron cores, respectively. Note that in FIG. 1 and FIG. 4, which is described later, illustration of the coils 51 to 53 is omitted for the sake of simplicity.

The outer peripheral iron core 20 is composed of a plurality of, for example, three, outer peripheral iron core portions 24 to 26 divided in the circumferential direction. The outer peripheral iron core portions 24 to 26 are formed integrally with the iron cores 41 to 43, respectively. The outer peripheral iron core portions 24 to 26 and the iron cores 41 to 43 are formed by stacking a plurality of iron plates, carbon steel plates, or electromagnetic steel sheets, or are formed from a dust core. When the outer peripheral iron core 20 is formed from a plurality of outer peripheral iron core portions 24 to 26, even if the outer peripheral iron core 20 is large, such a large outer peripheral iron core 20 can be easily manufactured. Note that the number of iron cores 41 to 43 and the number of iron core portions 24 to 26 need not necessarily be the same.

The coils 51 to 53 are arranged in coil spaces 51*a* to 53*a* formed between the outer peripheral iron core portions 24 to 26 and the iron cores 41 to 43, respectively. In the coil spaces 51*a* to 53*a*, the inner peripheral surfaces and the outer peripheral surfaces of the coils 51 to 53 are adjacent to the inner walls of the coil spaces 51*a* to 53*a*.

Further, the radially inner ends of the iron cores 41 to 43 are each located near the center of the outer peripheral iron core 20. In the drawings, the radially inner ends of the iron cores 41 to 43 converge toward the center of the outer peripheral iron core 20, and the tip angles thereof are approximately 120 degrees. The radially inner ends of the iron cores 41 to 43 are separated from each other via gaps 101 to 103, which can be magnetically coupled.

In other words, the radially inner end of the iron core 41 is separated from the radially inner ends of the two adjacent iron cores 42 and 43 via gaps 101 and 103. The same is true for the other iron cores 42 and 43. Note that, the sizes of the gaps 101 to 103 are equal to each other.

In the configuration shown in FIG. 1, since a central iron core disposed at the center of the core body 5 is not needed, the core body 5 can be constructed lightly and simply. Further, since the three iron core coils 31 to 33 are surrounded by the outer peripheral iron core 20, the magnetic fields generated by the coils 51 to 53 do not leak to the outside of the outer peripheral core 20. Furthermore, since the gaps 101 to 103 can be provided at any thickness at a low cost, the configuration shown in FIG. 1 is advantageous in terms of design, as compared to conventionally configured reactors.

Further, in the core body 5 of the present disclosure, the difference in the magnetic path lengths is reduced between the phases, as compared to conventionally configured reactors. Thus, in the present disclosure, the imbalance in inductance due to a difference in magnetic path length can be reduced.

Figure 3:
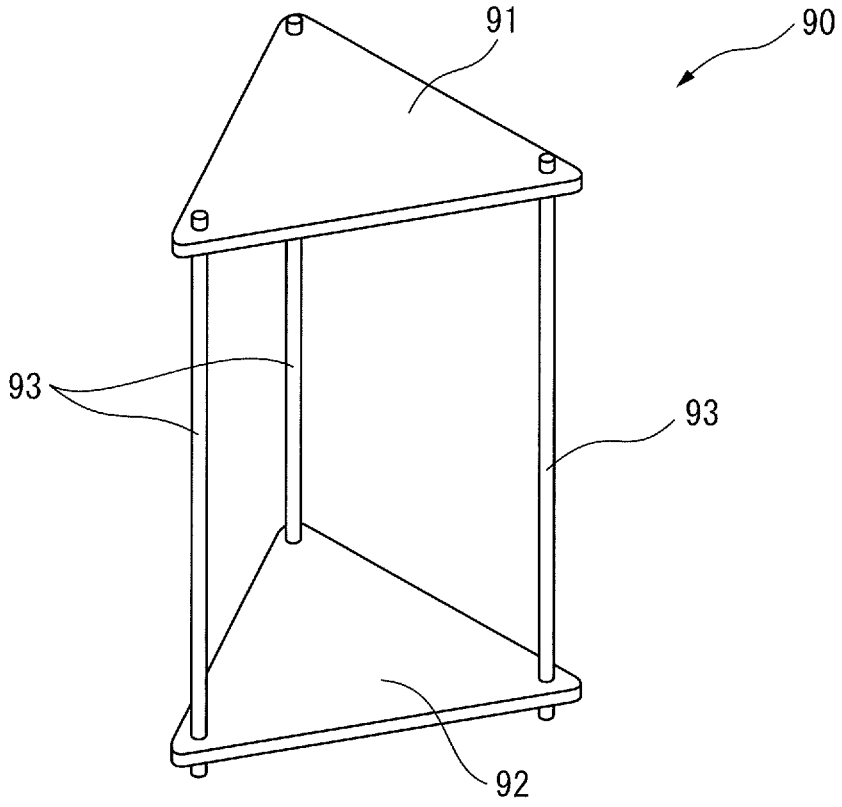
FIG. 3 is a perspective view of a fixture.

Referring again to FIG. 1, a fixture 90 is arranged in the center of the end surface of the core body 5. The fixture 9 functions to fasten the opposite ends of the iron cores 41 to 43 to each other. FIG. 3 is a perspective view of the fixture. As shown in FIG. 3, the fixture 90 includes plate members 91, 92 and a plurality of rod members 93 which connect the plate members 91, 92 to each other. These components of the fixture 90 are preferably formed from a non-magnetic material, such as aluminum, SUS, or a resin, and as a result, it is possible to prevent the magnetic field from passing through the fixture.

As can be understood from FIG. 1, the plate members 91, 92 are disposed on opposite end faces of the core body 5. It is preferable that the plate members 91, 92 have a triangular shape having an area large enough to include the gaps 101 to 103, so that the plate members 91, 92 do not interfere with the coils 51 to 53. Furthermore, the plate members 91, 92 may have other shapes. Another member that supports the rod members 93, such as a frame, may be used in place of the plate members 91, 92.

The plurality of rod members 93 extend through the interior of the core body 5 in the regions between the outer peripheral iron core 20 and the gaps 101 to 103. The rod members 93 are slightly larger than the height (height in the stacking direction) of the core body 5. Furthermore, threaded parts are formed on both ends of the rod members 93, and as a result, the rod members can be screwed into the corresponding holes formed in the plate members 91, 92.

Figure 4:
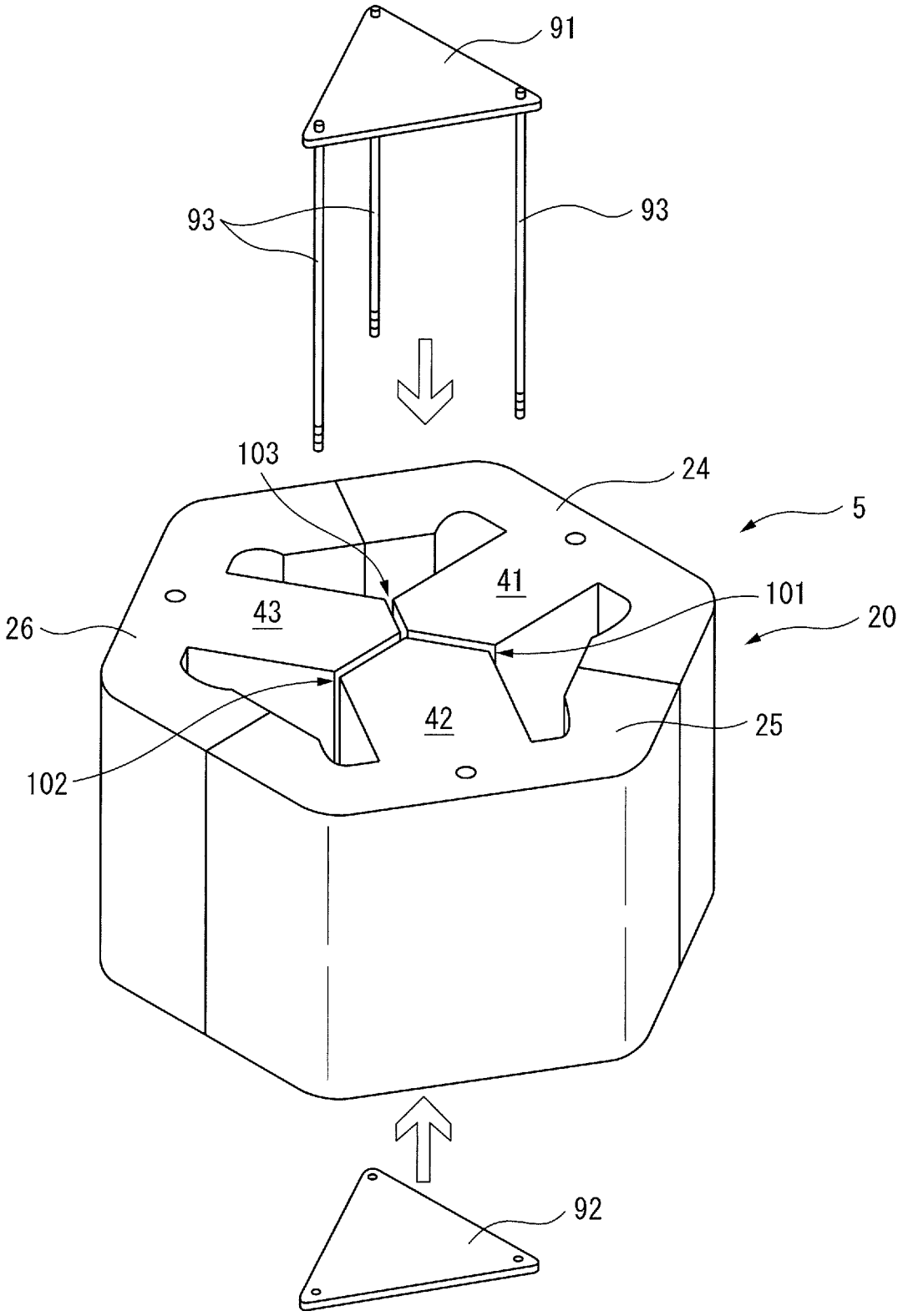
FIG. 4 is a view detailing the attachment of the fixture.

FIG. 4 is a view detailing the attachment of the fixture. As shown in the drawing, the plurality of rod members 93 are attached to the plate member 91 in advance. The plurality of rod members 93 are then positioned so as to be arranged in the regions between the outer peripheral iron core 20 and the gaps 101 to 103 when the fixture 90 is attached to the core body 5.

Then, the plate member 91 and the rod members 93 are moved toward one end face of the core body 5, so that the rod members 93 extend through the regions between the outer peripheral iron core 20 and the gaps 101 to 103. When the plate member 91 reaches one end face of the core body 5, the tips of the rod members 93 protrude from the other end of the core body 5. Then, the plate member 92 is disposed on the other end face side of the core body 5, and the rod members 93 are rotated to be screwed into the plate member 92. Other fasteners such as screws, bolts, or the like, may be used to connect the plate members 91, 92 and the rod members 93.

As described above, the areas of the plate member 91 and the plate member 92 are large enough to include the gaps 101 to 103. Thus, the opposite end portions of the plurality of iron cores 41 to 43 are tightly held by the rod members 93 when the core body 5 is interposed in the axial direction between the plate member 91 and the plate member 92.

Figure 5:
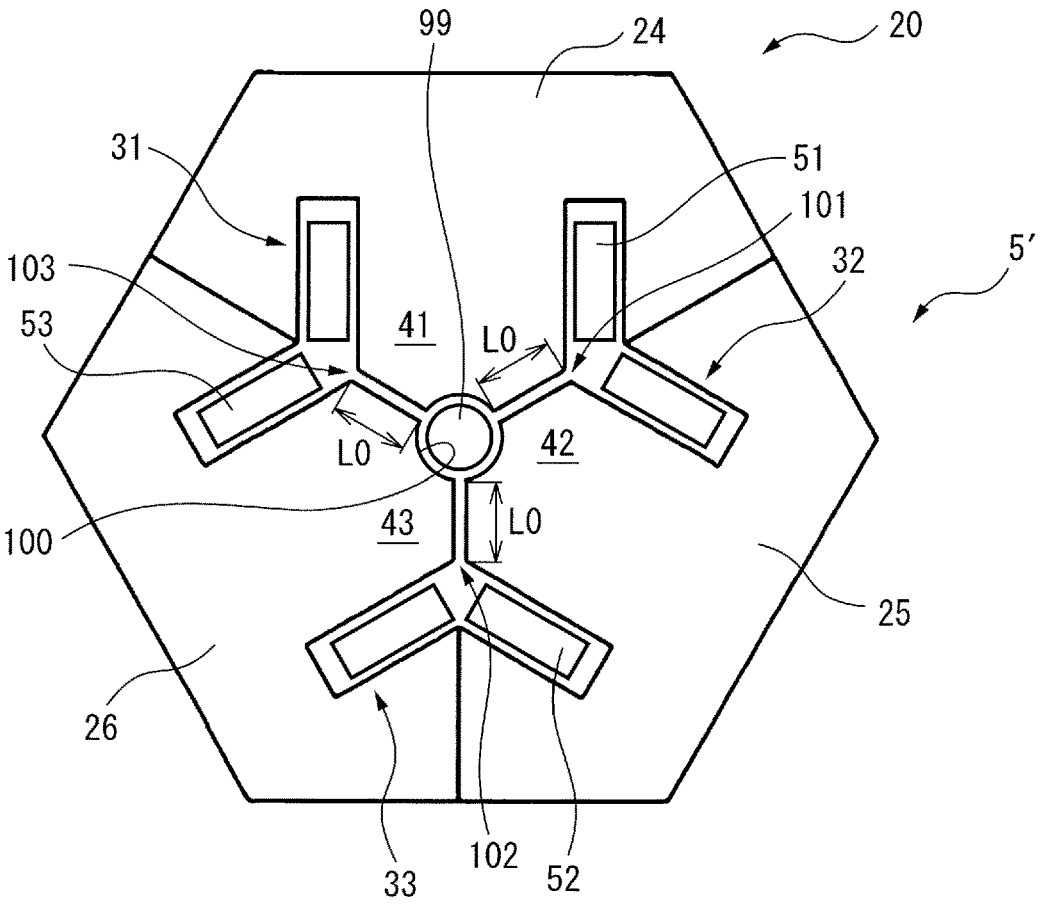
FIG. 5 is a cross-sectional view of the core body of a different reactor.

FIG. 5 is a cross-sectional view of the core body of a different reactor. The core body 5' of the different reactor shown in FIG. 5 has a configuration substantially the same as the core body 5 detailed with reference to FIG. 2. A through-hole 100 extending in the axial direction is formed at the center of the core body 5'. A rod member 99 is inserted into the through-hole. The opposite ends of the rod member 99 are fastened to both ends of the core body 5 by a fastening metal leaf, and as a result, the opposite ends of the iron cores 41 to 43 are fastened to each other.

In FIG. 5, since the opposite ends of the iron cores 41 to 43 are fastened by a single rod member 99, it is necessary to make the size of the through-hole 100 relatively large. As a result, the lengths L0 of the gaps 101 to 103 shown in FIG. 5 become shorter than the lengths L1 of the gaps 101 to 103 shown in FIG. 2. Thus, in order to secure the expected inductance, it is necessary to increase the width of the iron cores 41 to 43 to increase the length of the gaps 101 to 103 shown in FIG. 5 to length L1.

In regards thereto, in the present disclosure, since the rod members 93 of the fixture 90 extend through the regions between the gaps 101 to 103 and the iron core 20, it is not necessary to form the through-hole 100 in the center of the core body 5. Thus, when arranging the fixture 90, the length L1 of the gaps 101 to 103 does not change, and it is not necessary to increase the width of the iron cores to secure the necessary gap length L1. Thus, in the present disclosure, it is possible to prevent an increase in the size of the core body 5.

Figure 6:
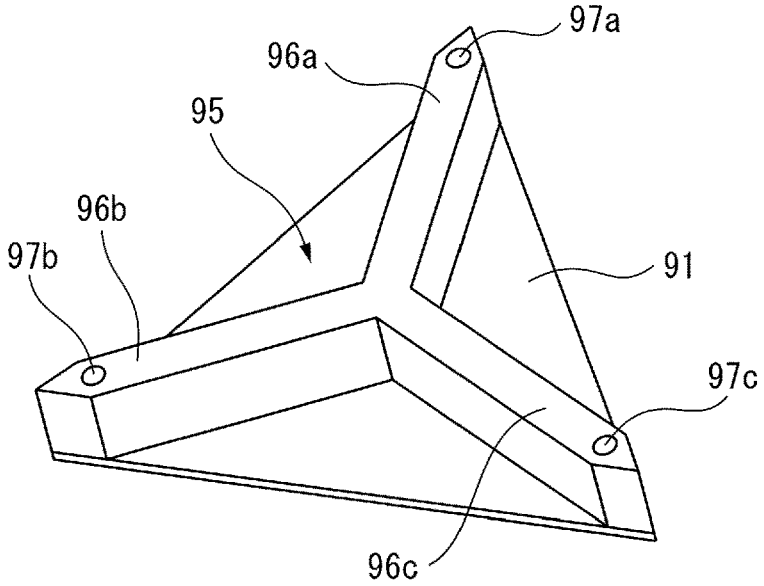
FIG. 6 is a perspective view of a plate member used in a reactor according to another embodiment.

Further, FIG. 6 is a perspective view of a plate member used in a reactor according to another embodiment. A substantially Y-shaped projection 95 is provided on one surface of the plate member 91. The projection 95 shown in FIG. 6 is composed of a number of raised portions 96*a* to 96*c*, the number of which is the same as the number of gaps 101 to 103. These raised portions 96*a* to 96*c* are arranged at equal intervals in the circumferential direction so as to correspond to the gaps 101 to 103. The projection 95 including the raise portions 96*a* to 96*c* is configured to be engageable with the gaps 101 to 103. A similar projection 95 may be provided on the plate member 92. However, providing a projection 95 on only the plate member 91 is sufficient.

Furthermore, recesses 97*a* to 97*c* are formed near the tips of the raised portions 96*a* to 96*c*, respectively. The ends of the rod members 93 can be screwed into these recesses 97*a* to 97*c*. Though not shown in the drawings, recesses or through-holes for engagement with the rod members 93 are formed on the plate member 91 or 92 which does not include a projection 95.

When the plate members 91, 92 including the projections 95 are used to fasten the opposite ends of the iron cores 41 to 43, since the projection 95 engages with the gaps 101 to 103, the iron cores 41 to 43 can be more tightly fastened. Furthermore, since it is not possible for the fixture 90 to rotate or move when the reactor 5 is driven, the generation of vibration or noise during driving of the reactor 5 can be prevented. Therefore, it is sufficient for the projection 95 to be formed to at least partially engage the gaps 101 to 103. For example, the projection 95 may include only two raised portions 96*a*.

Further, when the projection 95 as shown in FIG. 6 is provided, since the projection 95 functions as a lid, foreign matter can be prevented from entering the gaps 101 to 103. Furthermore, the projection 95 may function to maintain the dimensions of the gaps 101 to 103.

Figure 7:
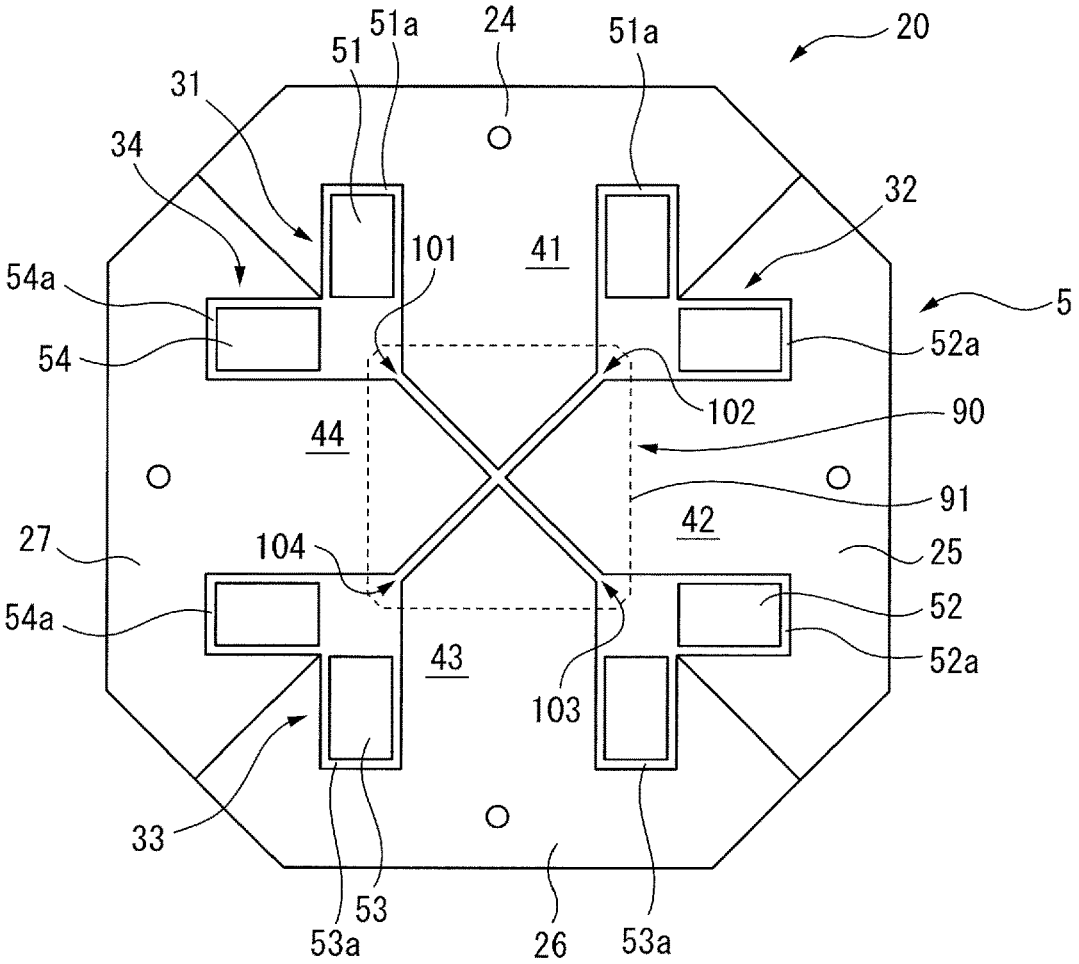
FIG. 7 is a cross-sectional view of the core body of a reactor according to a second embodiment.

The fixture 90 may be attached to a core body other than the core body 5 shown in FIG. 2 when driven as described above. For example, FIG. 7 is a cross-sectional view of the core body of a reactor according to a second embodiment. The core body 5 shown in FIG. 7 includes a substantially octagonal outer peripheral iron core 20 and four iron core coils 31 to 34, which are the same as the aforementioned iron core coils, arranged inside the outer peripheral iron core 20. These iron core coils 31 to 34 are arranged at equal intervals in the circumferential direction of the core body 5. Furthermore, the number of iron cores is preferably an even number of 4 or more, so that the reactor having the core body 5 can be used as a single-phase reactor.

As can be understood from the drawing, the outer peripheral iron core 20 is composed of four outer peripheral iron core portions 24 to 27 which are divided in the circumferential direction. The iron core coils 31 to 34 includes iron cores 41 to 44 extending in the radial direction and coils 51 to 54 wound around the respective iron cores, respectively. The radially outer end portions of the iron cores 41 to 44 are integrally formed with the adjacent peripheral iron core portions 21 to 24, respectively. The number of iron cores 41 to 44 and the number of the peripheral iron core portions 24 to 27 need not necessarily be the same. The same is true for core body 5 shown in FIG. 2.

Further, each of the radially inner ends of the iron cores 41 to 44 is located near the center of the outer peripheral iron core 20. In FIG. 7, the radially inner ends of the iron cores 41 to 44 converge toward the center of the outer peripheral iron core 20, and the tip angles thereof are about 90 degrees. The radially inner ends of the iron cores 41 to 44 are separated from each other via the gaps 101 to 104, through which magnetic connection can be established.

In FIG. 7, the plate member 91 of the fixture 90 is indicated by the dashed line. The plate member 91 has a square shape having an area, which is large enough to include the gaps 101 to 104, and the plate member 92 (not shown) has a similar shape. Thus, when the core body 5 is interposed in the axial direction between the plate member 91 and the plate member 92 by the rod members 93, which are not shown in FIG. 7, the opposite ends of the iron cores 41 to 44 are fastened to each other.

Figure 8:
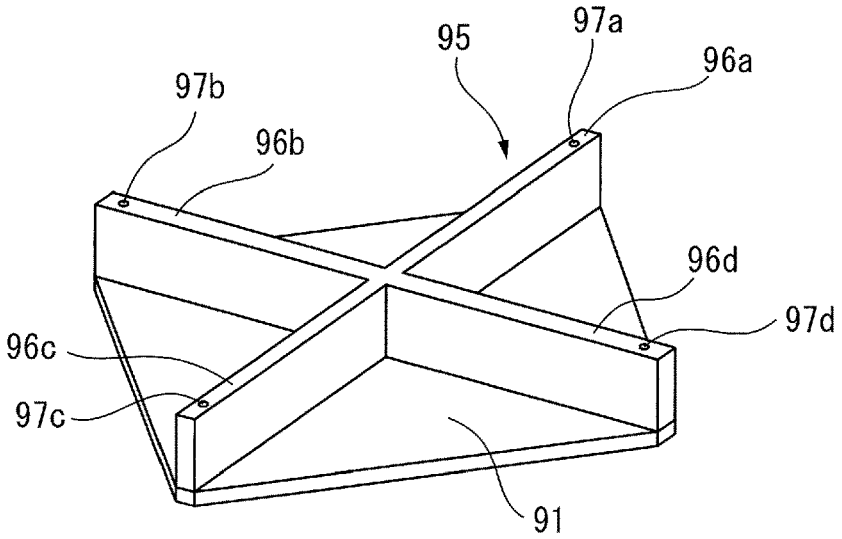
FIG. 8 is a perspective view of a plate member used in the reactor according to the second embodiment.

FIG. 8 is a perspective view of a plate member used in the reactor according to the second embodiment. The plate member 91 is provided on one surface thereof with a substantially X-shaped projection 95. The projection 95 shown in FIG. 8 includes raised portions 96*a* to 96*d*, similar to those described above, which are configured to be engageable with the gaps 101 to 104. Further, recesses 97*a* to 97*d* similar to those described above are formed near the tips of the raised portions 96*a* to 96*d*, respectively. When the plate members 91, 92 having such projections 95 are used, since the projections 95 engage with the gaps 101 to 104, the iron cores 41 to 44 can be more tightly fastened. Thus, the same effects as described above can be obtained.

Aspects of the Present Disclosure

According to the first aspect, there is provided a reactor (6) comprising a core body (5), the core body comprising an outer peripheral iron core (20) composed of a plurality of outer peripheral iron core portions (24 to 27), at least three iron cores (41 to 44) coupled to inner surfaces of the plurality of outer peripheral iron core portions, and coils (51 to 54) wound around the at least three iron cores, wherein gaps (101 to 104), which can be magnetically coupled, are formed between one of the at least three iron cores and another iron core adjacent thereto, the reactor further comprising a fixture (90) which extends through the interior of the core body in a region between the outer peripheral iron core and the gaps to fasten opposite ends of the at least three iron cores to each other.

According to the second aspect, in the first aspect, the fixture includes plate members (91, 92) arranged on both end surfaces of the core body, and rod members (93) which extend through the interior of the core body and connect the plate members to each other.

According to the third aspect, in the second aspect, the plate members are formed with a projection (95) which at least partially engages with the gaps.

According to the fourth aspect, in any of the first aspect through the third aspect, the number of the at least three iron cores is a multiple of three.

According to the fifth aspect, in any of the first aspect through the third aspect, the number of the at least three iron cores is an even number not less than 4.

According to the sixth aspect, in any of the first aspect through the fifth aspect, the fixture is formed from a non-magnetic material.

Effects of the Aspects

In the first aspect, since the fixture extends through the interior of the core body in the region between the outer peripheral iron core and the gaps, it is not necessary to increase the width of the iron cores to ensure the gap length. Thus, it is possible to tightly fasten the plurality of iron cores without an increase in size.

In the second aspect, the fixture can be constructed relatively simply.

In the third aspect, since the projection engages the gaps, the iron cores can be further tightly fastened. Further, it is possible to prevent foreign matter from entering the gaps, and it is possible to maintain the dimensions of the gaps.

In the fourth aspect, the reactor can be used as a three-phase reactor.

In the fifth aspect, the reactor can be used as a single-phase reactor.

In the sixth aspect, the non-magnetic material is preferably, for example, aluminum, SUS, a resin, or the like, and as a result, it is possible to prevent the magnetic field from passing through the fixture.

Though the present invention has been described using representative embodiments, a person skilled in the art would understand that the foregoing modifications and various other modifications, omissions, and additions could be made without departing from the scope of the present invention.

The invention claimed is:

1. A reactor, comprising:

a core body, the core body comprising:

an outer peripheral iron core composed of a plurality of outer peripheral iron core portions, at least three iron cores coupled to inner surfaces of the plurality of outer peripheral iron core portions, and coils wound around the at least three iron cores, radially inner ends of each of the at least three iron cores being arranged in the vicinity of a center of the outer peripheral iron core and converging toward the center of the outer peripheral iron core; wherein gaps, which can be magnetically coupled, are formed between one of the at least three iron cores and another iron core adjacent thereto, and the radially inner ends of the at least three iron cores are spaced from each other via the gaps, which can be magnetically coupled; the reactor further comprising:

a fixture which extends, through the interior of the outer peripheral iron core in a region between the outer peripheral iron core and the gaps to fasten opposite ends of the at least three iron cores to each other in the axial direction of the core body.

2. The reactor according to claim 1, wherein the fixture is formed from a non-magnetic material.

3. The reactor according to claim 1, wherein the fixture includes plate members arranged on both end surfaces of the core body, and rod members which extend through the interior of the outer peripheral iron core and connect the plate members to each other.

4. The reactor according to claim 3, wherein projections which at least partially engage with the gaps are formed on the plate members.

5. The reactor according to claim 1, wherein the number of the at least three iron cores is a multiple of three.

6. The reactor according to claim 1, wherein the number of the at least three iron cores is an even number not less than 4.

7. A reactor, comprising:

a core body, the core body comprising:

an outer peripheral iron core composed of a plurality of outer peripheral iron core portions, at least three iron cores coupled to inner surfaces of the plurality of outer peripheral iron core portions, and coils wound around the at least three iron cores, radially inner ends of the at least three iron cores being arranged in the vicinity of a center of the outer peripheral iron core and converging towards the center of the outer peripheral iron core; wherein gaps, which can be magnetically coupled, are formed between one of the at least three iron cores and another iron core adjacent thereto, and the radially inner ends of the at least three iron cores are spaced from each other via the gaps, which can be magnetically coupled; the reactor further comprising:

a fixture which extends through the interior of the outer peripheral iron core in a region between the outer peripheral iron core and the gaps to fasten opposite ends of the at least three iron cores to each other; wherein the fixture includes plate members arranged on both end surfaces of the core body, and rod members which extend through the interior of the outer peripheral iron core and connect the plate members to each other.

* * * * *